US005369559A

United States Patent [19]

Hedrick et al.

[11] Patent Number: 5,369,559

[45] Date of Patent: Nov. 29, 1994

[54] TROUBLE LIGHT ASSEMBLY

[75] Inventors: Paul A. Hedrick, Taylor Mill, Ky.; Thomas Varatta, Sr., Greenville, R.I.

[73] Assignee: General Cable Industries, Inc., Highland Heights, Ky.

[21] Appl. No.: 106,065

[22] Filed: Aug. 13, 1993

[51] Int. Cl.[5] ..... F21V 15/00

[52] U.S. Cl. ..... 362/376; 362/377; 362/451

[58] Field of Search ..... 362/376, 377, 451

[56] References Cited

U.S. PATENT DOCUMENTS

| | | | |
|---|---|---|---|
| 3,761,862 | 9/1993 | Spiteri | 439/505 |
| 4,225,910 | 9/1980 | Conte | 362/376 |
| 4,275,435 | 6/1981 | Dorn | 362/376 |
| 4,639,842 | 1/1987 | Upchurch | 362/376 |
| 4,644,456 | 2/1987 | Lydell | 362/377 |

*Primary Examiner*—Larry Jones
*Attorney, Agent, or Firm*—Salter & Michaelson

[57] ABSTRACT

A trouble light assembly includes a handle portion, a door in the handle portion which is hingeably movable between open and closed positions, a bulb receptacle mounted at one end of the handle portion, a cage portion adjacent the bulb receptacle for enclosing a bulb therein, and a plurality of conductor blades which are electrically connected to the bulb receptacle. The conductor blades extend downwardly from the bulb receptacle so as to define a male conductor plug within the handle portion. The female end of a extension cord set is received into the handle portion through the hinged door, and matingly engaged with the conductor blades so as to establish an electrical connection between the bulb receptacle and the cord set. In a first embodiment, the hinged door is permanently sealed in the closed position after assembly of the cord set, and in a second embodiment the hinged door is provided with a tab and slot assembly for releasably maintaining the door in the closed position.

15 Claims, 4 Drawing Sheets

TROUBLE LIGHT ASSEMBLY

BACKGROUND AND SUMMARY OF THE INVENTION

The instant invention relates to a light assembly of the type commonly referred to as a "trouble light", and more particularly to a trouble light assembly wherein the bulb receptacle includes conductor blades that define a male conductor plug.

A conventional trouble light assembly comprises a tubular handle portion, a bulb receptacle mounted at the top end of the handle portion, a cage portion at the top end of the handle portion for enclosing a bulb received in the bulb receptacle, and an integral cord set wherein the positive, neutral and ground wires of the cord set are electrically connected to the electrical terminals of the bulb receptacle. The cord set extends outwardly through an aperture in the bottom of the handle portion and the terminal end of the cord set includes a male conductor plug which may be inserted into an electrical socket to supply power to the bulb receptacle. The manufacture of trouble light assemblies is known to be labor intensive because of the electrical connections that must be made manually between the cord set wires and the electrical terminals of the bulb receptacle. While the individual wiring connections between the cord set and the electrical terminals of the bulb receptacle are not difficult to accomplish, it has been found that assembly workers who repetitively perform these wiring connections often develop carpal tunnel syndrome which is painful for the employee and costly for the employer in terms of worker's compensation insurance.

The instant invention provides a trouble light assembly which is much easier to assemble than a conventional trouble light assembly. The light assembly of the subject invention comprises a tubular handle portion, a hinged door in the handle portion, a bulb receptacle mounted in the handle portion, a cage portion mounted adjacent the bulb receptacle, and three conductor blades which are electrically connected to the electrical terminals of the bulb receptacle. The three conductor blades extend downwardly from the bulb receptacle into the handle portion where they are arranged so as to define a male conductor plug. A conventional extension cord set is assembled with the light assembly wherein the female conductor plug of the cord set is received into the handle portion through the hinged door, and then slidably engaged over the conductor blades. The cord set extends outwardly from the handle portion through an aperture defined by the hinged door and the handle portion. It can therefore be seen that the provision of male conductor blades on the bulb receptacle greatly reduces assembly labor because the manual connections between the cord set wires and the terminals of the bulb receptacle are eliminated. In a first embodiment of the instant trouble light assembly, the female conductor plug of the cord set is maintained in assembled relation with the conductor blades by means of a circular collar in the handle portion, and the hinged door is permanently sealed shut after assembly so that the trouble light and cord set assembly can be sold as a combined unit. In a second embodiment, the female conductor plug of the cord set is maintained in assembled relation with the conductor blades by means of a rotatable collar mounted in the handle portion, and the hinged door includes a releasable latching means for releasably maintaining the door in the closed position.

In this manner, the trouble light assembly may be sold as an individual unit wherein the purchaser may use the trouble light with an existing cord set.

It is thus an object of the instant invention to provide a trouble light assembly in which the bulb receptacle includes conductor blades that are arranged so as to define a male conductor plug.

It is another object to provide a trouble light which is powered by a conventional extension cord set.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
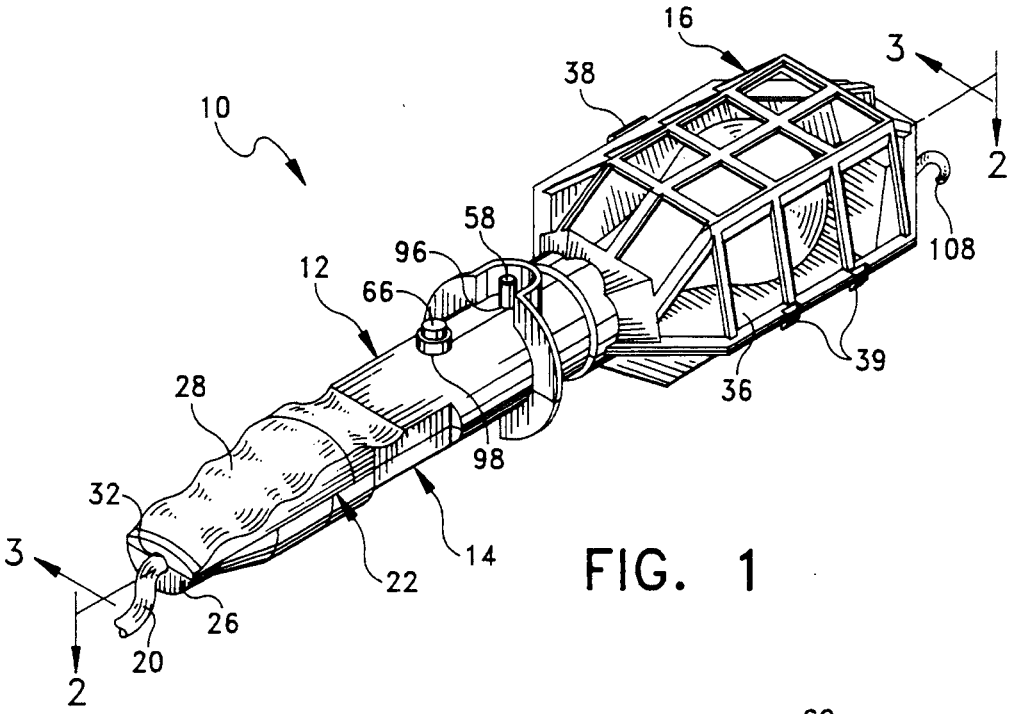
FIG. 1 is a perspective view the trouble light of the instant invention.
Figure 2:
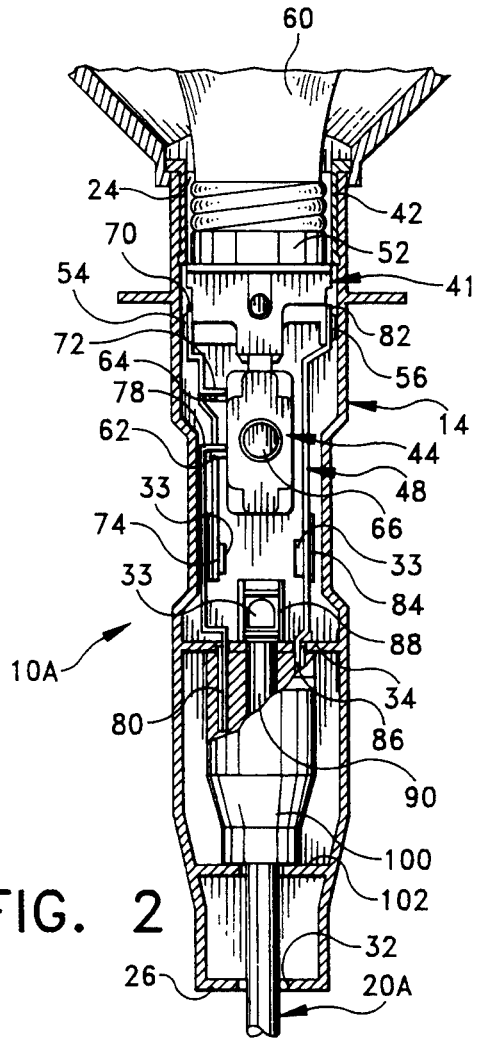
FIG. 2 is a cross-sectional view of a first embodiment of the instant trouble light taken along line 2—2 in FIG. 1.
Figure 3:
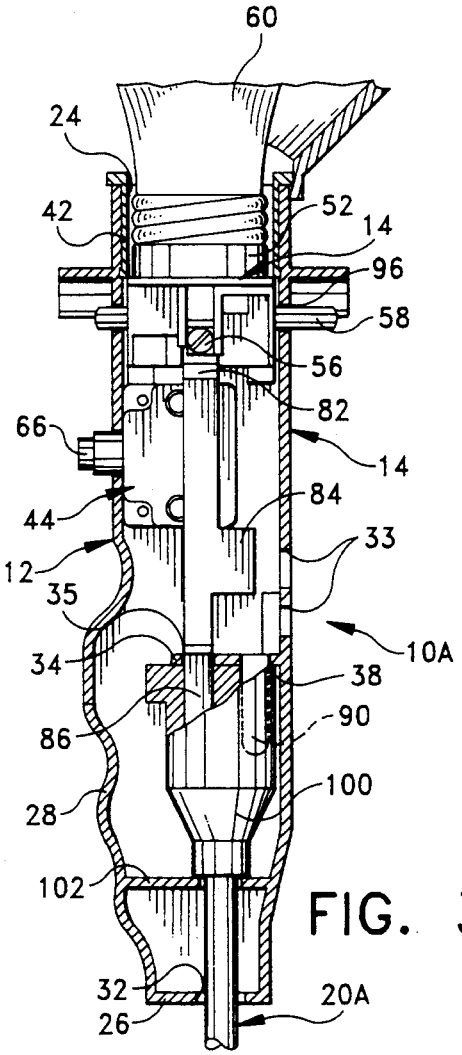
FIG. 3 is another cross-sectional view of the first embodiment taken along line 3—3 in FIG. 1.
Figure 4:
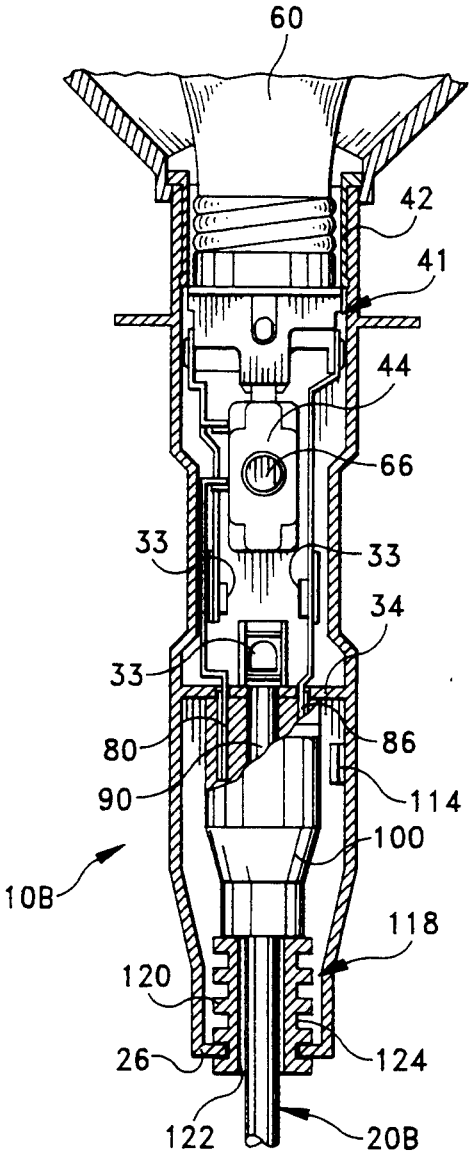
FIG. 4 is a cross-sectional view of a second embodiment of the instant trouble light taken along line 2—2 in FIG. 1.

Referring now to the drawings, the trouble light assembly of the instant invention is illustrated and generally indicated at 10 in FIG. 1. As will hereinafter be more fully described, a first embodiment 10A of the instant invention includes a pre-assembled extension cord set, and a second embodiment 10B is designed for user assembly of an independent extension cord set with the light assembly 10. Referring to FIGS. 1, 2, 3, and 6, the first embodiment 10A comprises front and rear housing section halves generally indicated at 12 and 14 respectively, a cage section generally indicated at 16, an electrical assembly generally indicated at 18, and an extension cord set generally indicated at 20A.

Figure 6:
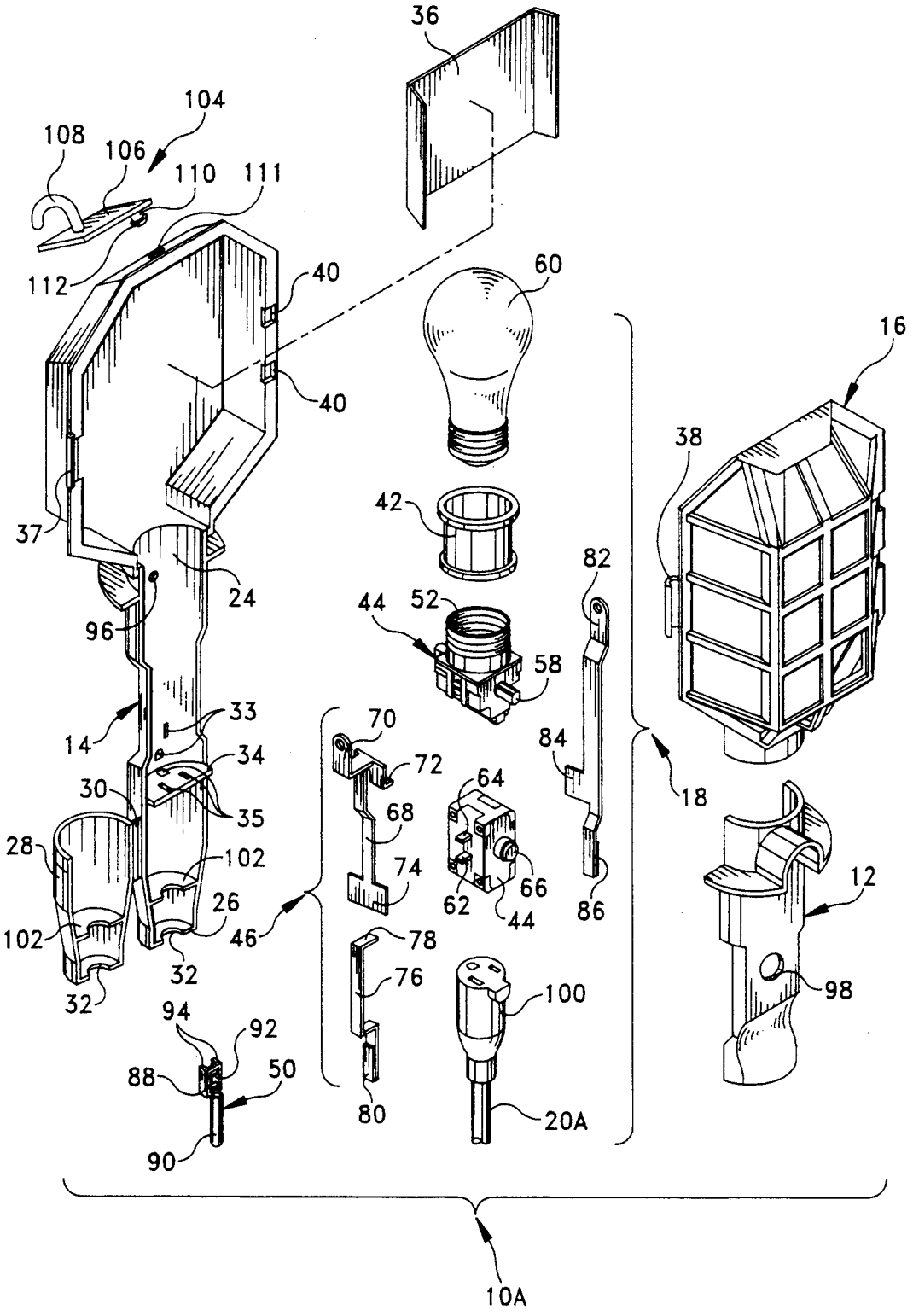
FIG. 6 is an exploded perspective view of the first embodiment.
Figure 7:
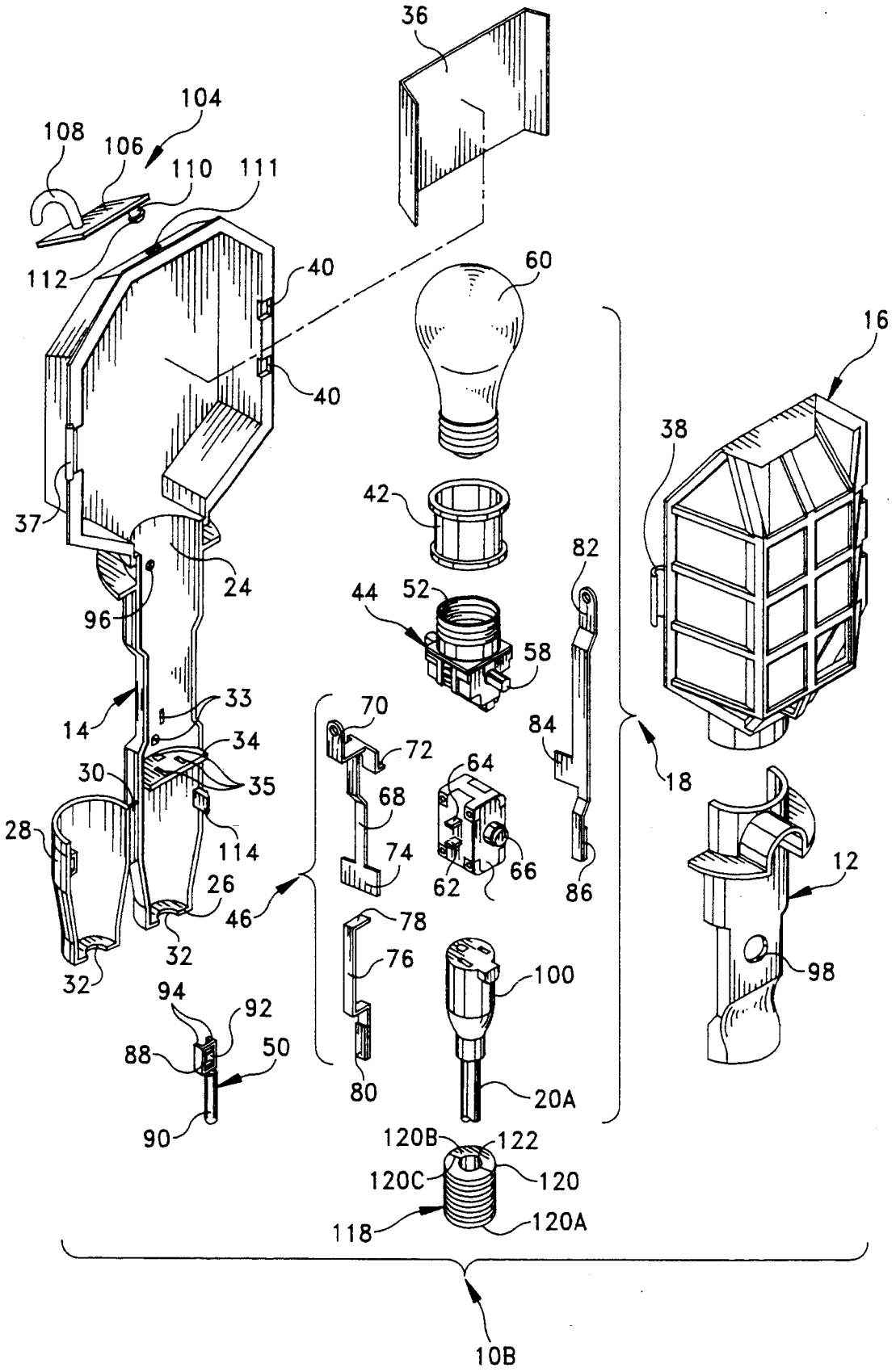
FIG. 7 is an exploded perspective view of the second embodiment.

The front and rear housing section halves 12 and 14, and the cage section 16 are preferably molded from plastic. The front and rear sections 12 and 14 are received and secured together, such as by welding or epoxy, so as to define a tubular handle portion generally indicated at 22. The tubular handle portion 22 has an open upper end 24, and a bottom wall 26 (see FIGS. 2, 3 and 6). The rear housing section half 14 includes a door 28 which is attached to the rear housing section half 14 by means of an integrally formed living hinge 30. In this connection, the door 28 is hingeably movable between an open position, as illustrated in FIG. 6 and a closed position as illustrated in FIG. 1. When the door 28 is in its closed position, (FIG. 1) it cooperates with rear housing section half 14 to define an opening 32 in the closed end 26 of the handle portion 20. The rear housing section half 14 further includes a set of spaced blade openings 33 therein which are arranged to slidably receive the conductor blades a second cord set (not shown). The rear housing section half 12 still further includes an inner bulkhead 34 having a set of spaced blade openings therein 35. In order to more effectively reflect light from the opaque plastic housing, the rear housing section 14 is provided with a shiny metallic panel 36 which is positioned against the rear wall of the cage portion of the rear body section 14 as illustrated in FIG. 6. The panel 36 is secured in position by an adhesive, or alternatively, the panel 36 may be secured by means of tabs (not shown) which project outwardly from the rear wall of the cage portion. The reflector is operative for providing a higher reflectivity than standard plastic, and it is further operative as a heat sink for absorbing and dissipating heat given off by a bulb.

The cage section 16 is hingeably connected to the rear section 14 so as to define a cage for a light bulb. The hinge connection is formed by a hinge pin 37 on the rear housing section 14 and a curved flange 38 on the cage section 16. The curved flange 38 is slidably and rotatably received around the hinge pin 37 in a conventional manner so that the cage section 16 is movable between open and closed positions. In order to maintain the cage section 16 in the closed position, the cage section 16 is provided with a pair of tab elements 39 which are releasably receivable into a pair of apertures 40 in the rear housing section 14.

The electrical assembly 16 comprises a bulb receptacle generally indicated at 41, a receptacle collar 42, a circuit breaker unit generally indicated at 44, a positive conductor assembly generally indicated at 46, a neutral conductor element generally indicated at 48 and a ground conductor element generally indicated at 50. The bulb receptacle 41 is conventional in the art and it comprises a light bulb socket 52, a positive electrical terminal 54, a neutral electrical terminal 56 and a slide switch 58 for opening and closing the electric circuit between the positive 54 and neutral terminals 56. The bulb receptacle 41 and the receptacle collar 42 are received adjacent the upper end 24 of the handle portion 22 so that when a light bulb 60 is threadedly received into the socket 52, the light bulb 60 extends upwardly so as to be received in the cage of the light assembly 10. The receptacle collar 42 is operable as a stabilizing element for maintaining the bulb receptacle 41 in an upright position. The circuit breaker unit 44 is also conventional in the art and it includes an input terminal 62, an output terminal 64, and a manual reset switch 66. The positive conductor assembly 46 comprises a base element 68 having a first land portion 70 which is connected to the positive terminal 54 of the bulb receptacle 42, a second land portion 72 which is connected to the output terminal 64 of the circuit breaker unit 44 and a third land portion 74 which is arranged so as to lie adjacent to the blade openings 36 in the handle portion 22. The positive conductor assembly 46 further comprises a blade element 76 having a land portion 78 which is connected to the input terminal 62 of the circuit breaker 44 and a blade portion 80. The neutral conductor element 48 includes a first land portion 82 which is connected to the neutral terminal 56 of the bulb receptacle 42, a second land portion 84 which is arranged so as to lie adjacent to the blade openings 36 in the handle portion 20, and a blade portion 86. The ground conductor element 50 comprises a land portion 88 and a blade portion 90. The land portion 88 includes a bore 92 and plurality of mounting fingers 94 which are operative for being imbedded into the rear housing section half 14. When the ground conductor element 50 is mounted in position, the bore 92 is in axial alignment with the corresponding ground aperture 33 in the rear housing section half 14 and the blade portion 90 extends downwardly through the corresponding ground aperture 35 in the bulkhead 34. When the electrical assembly 16 is mounted with the handle portion 20, the opposite ends of the slide switch 58 extend outwardly from the handle portion 20 through a pair of opposing apertures 96 formed in the front and rear housing section halves 12 and 14 (see FIG. 3), the reset switch 66 of the circuit breaker unit 42 extends outwardly through an aperture 98 in the front body section half 12, and the blade portions 80 and 86 of the respective conductor elements 46 and 48 extend through the corresponding blade openings 45 in the bulkhead 34. It can therefore be seen that the blade portions 80, 86 and 90 of the three conductor elements 46, 48 and 50 cooperate to define a male conductor plug within the handle portion 22. The cord set 20A comprises a conventional electric cord set having a female plug end 100 and a male plug end (not shown). For assembly of the cord set 20A with the light assembly 10, the female plug end 100 is extended through the open door 28 and into the handle portion 22 wherein the female conductor plug 100 is matingly engaged with the blade portions 80, 86 and 90 of the conductor elements 46, 48 and 50 (see FIGS. 2 and 3). More specifically, the female plug end 100 is slidably received over the blades 80, 86 and 90 until it comes to rests against the bulkhead 34. In order to maintain the female plug end 100 in engaged relation with the blades 80, 86, and 90, the door 28 and rear housing section half 14 are provided with annular collar portions 102 which cooperate to engage the cord set 20A below the female plug end 100 when the door 28 is in the closed position. It is pointed out that the cord set 20A extends outwardly from the closed end 26 of the handle portion 22 through the aperture 32 formed by cooperation of the door 28 and the rear hosing section half 14. In the instant embodiment, the hinged door 28 is permanently sealed shut after assembly, such as by epoxy, welding or tamper proof latching (not shown), wherein the light assembly 10 and the cord set 18 become an integral unit.

It can further be seen that the land portions 74, 84 and 88 of the conductor elements 46, 48, and 50 are operative for sliding engagement with the male conductor blades of a second cord set (not shown) when the blades are slidably extended through the blade apertures 33.

When the female plug end 100 of the cord set 20A is assembled with the light assembly 10 and the male plug end of the cord set 20A is engaged with an electrical socket, power is supplied to the bulb receptacle 41 through the positive conductor assembly 46. Electric current flowing through the cord set 18 travels through the positive blade element 76, through the circuit breaker unit 44 and through the base element 68 to the positive terminal 54 of the bulb receptacle 41. The slide switch 58 is operative in a conventional manner for opening and closing a circuit path between the positive and neutral terminals 54 and 56 of the bulb receptacle 41 so as to permit current flow through the bulb receptacle 41 and energize the bulb 60 received therein.

The instant light assembly 10A is further provided with a rotatable hook element generally indicated at 104. The hook element 104 comprises a flat plate 106 having an upwardly extending curved hook 108, and a downwardly extending pivot pin 110. For mounting of the hook element 104 onto the light assembly 10A, the pivot pin 110 is received into an aperture in the top portion of the rear housing section 14, and it is frictionally held in position by an increased diameter shoulder portion 112.

Figure 5:
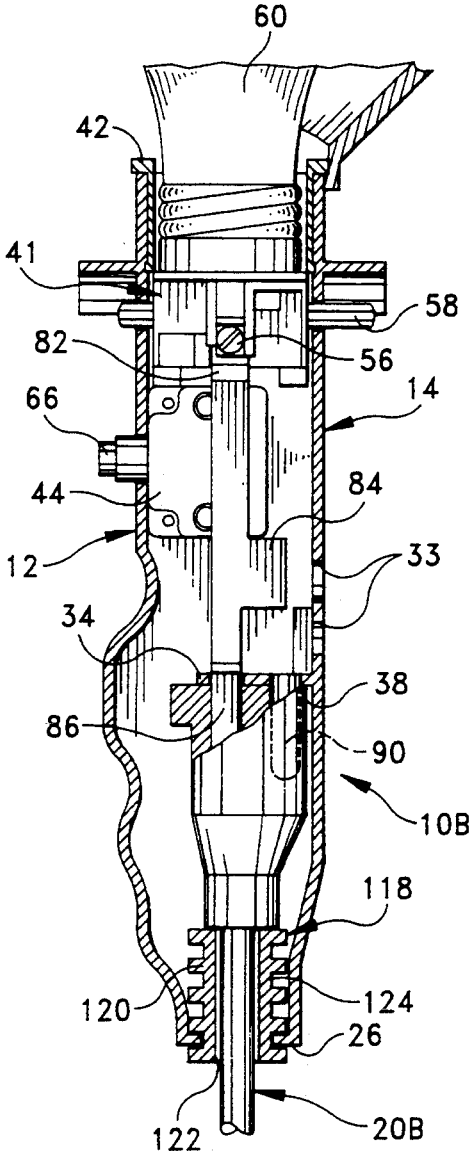
FIG. 5 is another cross-sectional view of the second embodiment taken along line 3—3 in FIG. 1.

Referring now to FIG. 5, a second embodiment of the instant light assembly is illustrated and generally indicated at 10B. The second embodiment 10B is substantially identical to the first embodiment 10 with two exceptions. Instead of being sealed closed, the hinged door 28 and the rear body section half 14 are provided with complementary tab 114 and slot 116 means for releasably maintaining the door 28 in the closed position. In this connection, the light assembly 104 does not include an integral cord set 20A, so that the light assembly 10 may be operated with an existing cord set 20B. In order to accommodate the mounting of different size plug bodies into the handle portion 22, the fixed collar 102 of the first embodiment 10B is replaced by an adjustable rotatable collar generally indicated at 118. The collar 118 comprises a cylindrical body 120 having an axial bore 122, and a plurality of external circumferential grooves 124. In order to mount the collar 118 onto a cord set 20B, the cylindrical body 120 is divided into two section 120A and 120B which are connected by a living hinge 120C. In use, the collar 118 is mounted onto the cord set substantially as illustrated in the drawing figures, i.e. immediately adjacent to the plug body. Thereafter, the plug body is slidably mounted over the conductor blades and the hinged door 28 is closed so that one of the grooves 124 is received and engaged with the bottom wall of the handle portion. It is readily apparent, that the collar is adjustable upwardly and downwardly by engaging different grooves with the aperture in the bottom wall of the handle portion. It can therefore be seen that the collar 124, is rotatable with respect to both the cord set and the handle portion. It can also be readily appreciated that assembly of the cord set 20B with the light assembly 10B is easily accomplished so that the cord 20B set may be repeatedly assembled with It can therefore be seen that instant invention provides two unique and improved trouble light assemblies 10A and 10B which are easier to assemble than conventional trouble light assemblies. The bulb receptacle 41 of the light assemblies 10A and 10B are provided with a set of conductor blades 46, 48 and 50 which are arranged in the handle portion 22 of the light assembly 10 so as to define a male conductor plug. Assembly of the trouble lights 10A or 10B with a cord set 20 is easily accomplished by mating engagement of the female end 100 of a cord set 20 with the conductor blades 80, 86 and 90. In a first embodiment 10A, the hinged door 28 is sealed shut so as to integrally maintain the cord set 20 with the light assembly on a permanent basis. In a second embodiment 10B, the hinged door 28 is provided with a releasable tab and slot arrangement so that the cord set 20 may be assembled with and disassembled from the light assembly as desired. For these reasons, the light assembly of the instant invention is believed to represent a significant advancement in the art which has substantial commercia merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A trouble light assembly comprising:

a handle portion having first and second ends;

a bulb receptacle mounted at said first end of said handle portion, said bulb receptacle having a positive terminal and a neutral terminal;

a cage portion mounted adjacent said first end of said handle portion for enclosing a light bulb received in said bulb receptacle;

positive and neutral conductor blades respectively connected to said positive and neutral terminals of said bulb receptacle, said positive and neutral conductor blades extending downwardly from said bulb receptacle so as to define a male conductor plug in said handle portion, said positive and neutral conductor blades being matingly engageable with a female plug end of a cord set, said female plug end being received in said tubular handle portion so that a terminal end of said cord set extends outwardly from said second end of said handle portion; and means within said handle portion for securing said female plug end in engagement with said conductor blades.

2. In the trouble light assembly of claim 1, said handle portion including a hinged door adjacent said second end which is hingeably movable between an open position and a closed position, said door and said handle portion cooperating to define an aperture in said second end of said handle portion when said door is in said closed position, said female conductor plug being receivable in said handle portion through said door, said cord set extending outwardly from said second end of said handle portion through said aperture.

3. The trouble light assembly of claim 2 further comprising means for maintaining said door in said closed position.

4. The trouble light assembly of claim 2 further comprising means for releasably maintaining said door in said closed position.

5. In the trouble light assembly of claim 4, said means for releasably maintaining said door in said closed position comprising an interengaging tab and slot assembly.

6. In the trouble light assembly of claim 2, said means for securing said female plug end comprising annular collar portions on said door and said housing which cooperate to engage said cord set immediately below said female plug end when said door is in a closed position.

7. In the trouble light assembly of claim 1, said handle portion and said cage portion being integrally formed from plastic.

8. The trouble light assembly of claim 1 further comprising a ground conductor blade positioned within said handle portion adjacent said positive conductor blade and said neutral conductor blade.

9. The trouble light assembly of claim 1 further including collar means adjacent said second end of said handle portion for engaging said female plug end and for maintaining said female plug end in mating engagement with said conductor blades.

10. The trouble light assembly of claim 1 further including a rotatable collar comprising a cylindrical body and having an axial bore and a plurality of external circumferential grooves therein, said collar being receivable in an aperture in a bottom wall of said handle portion so that one of said grooves is in engagement with said aperture and said cord set extends through said axial bore.

11. A trouble light assembly comprising:

a handle portion having first and second ends;

a bulb receptacle mounted at said first end of said handle portion, said bulb receptacle having a positive terminal and a neutral terminal;

a cage portion mounted adjacent said first end of said handle portion for enclosing a light bulb received in said bulb receptacle; and positive and neutral conductor blades respectively connected to said positive and neutral terminals of said bulb receptacle, said positive and neutral conductor blades extending downwardly from said bulb receptacle so as to define a male conductor plug in said handle portion, said positive and neutral conductor blades being matingly engageable with a female plug end of a cord set, said female plug end being receivable and securable in said tubular handle portion so that a terminal end of said cord set extends outwardly from said second end of said handle portion, said trouble light assembly further comprising a circuit breaker unit electrically connected between said positive terminal of said bulb receptable and said positive conductor blade, said circuit breaker including a manual reset switch, said reset switch extending outwardly from said handle portion.

12. A trouble light assembly comprising:

a handle portion having first and second ends;

a bulb receptacle mounted at said first end of said handle portion, said bulb receptacle having a positive terminal and a neutral terminal;

a cage portion mounted adjacent said first end of said handle portion for enclosing a light bulb received in said bulb receptacle; and positive and neutral conductor blades respectively connected to said positive and neutral terminals of said bulb receptacle, said positive and neutral conductor blades extending downwardly from said bulb receptacle so as to define a male conductor plug in said handle portion, said handle portion including a pair of spaced blade apertures positioned between said first and second ends, said positive and neutral conductor blades each including a land portion positioned adjacent said spaced blade apertures, said land portions being operable for slidably engaging the conductor blades of a second cord set when said conductor blades are slidably extended through said spaced blade apertures, said positive and neutral conductor blades being matingly engageable with a female plug end of a cord set, said female plug end being receivable and securable in said tubular handle portion so that a terminal end of said cord set extends outwardly from said second end of said handle portion.

13. A trouble light assembly comprising:

a handle portion having first and second ends, and a hinged door adjacent said second end;

a bulb receptacle mounted at said first end of said handle portion, said bulb receptacle having a positive terminal and a neutral terminal;

a cage portion mounted adjacent said first end of said handle portion for enclosing a light bulb received in said bulb receptacle;

a circuit breaker having a manual reset switch, an input terminal and an output terminal;

a positive conductor assembly connected to said positive terminal of said bulb receptacle, said positive conductor assembly comprising a base element having first land portion which is connected to said positive terminal of said bulb receptacle, and a second land portion which is connected to said output terminal of said circuit breaker, said positive conductor assembly further comprising a blade element having a first land portion which is connected to said input terminal of said circuit breaker, and a blade portion; and a neutral conductor element including a first land portion which is connected to said neutral terminal of said bulb receptacle, and a blade portion, said blade portion of said blade element and blade portion of said neutral conductor element being arranged in spaced relation so as to define a male conductor plug in said handle portion, said blade portions being matingly engageable with a female plug end of a cord set, said female plug end being extendable through said hinged door so that a terminal end of said cord set extends outwardly of said second end of said handle portion.

14. In the trouble light assembly of claim 13, said door and said handle portion cooperating to define an aperture in said second end of said handle portion when said door is in said closed position, said female conductor plug being receivable in said handle portion through said door, said cord set extending outwardly from said second end of said handle portion through said aperture.

15. In the trouble light assembly of claim 13, said handle portion further including at least two blade apertures positioned between said first and second ends, said base element further including a third land portion which is positioned adjacent to one of blade apertures in said handle portion, said neutral conductor element further including a second land portion which is positioned adjacent to a second of blade apertures in said handle portion, said land portions being operable for slidably engaging the conductor blades of a second cord set when said conductor blades are slidably extended through said blade apertures.

* * * * *